US011268356B2

(12) United States Patent
Dusterhoft et al.

(10) Patent No.: US 11,268,356 B2
(45) Date of Patent: Mar. 8, 2022

(54) CASING CONVEYED, EXTERNALLY MOUNTED PERFORATION CONCEPT

(71) Applicant: Halliburton Energy Services, Inc., Houston, TX (US)

(72) Inventors: Ronald Glen Dusterhoft, Katy, TX (US); Jonathan Paul Smith, Katy, TX (US); Michael Linley Fripp, Carrollton, TX (US); James Marshall Barker, Mansfield, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 72 days.

(21) Appl. No.: 16/454,374

(22) Filed: Jun. 27, 2019

(65) Prior Publication Data

US 2020/0003033 A1 Jan. 2, 2020

Related U.S. Application Data

(60) Provisional application No. 62/692,125, filed on Jun. 29, 2018.

(51) Int. Cl.

| | |
|---|---|
| ***E21B 43/116*** | (2006.01) |
| ***E21B 33/14*** | (2006.01) |
| ***E21B 47/12*** | (2012.01) |
| ***E21B 17/10*** | (2006.01) |

(52) U.S. Cl.

CPC ..... *E21B 43/116* (2013.01); *E21B 17/1078* (2013.01); *E21B 33/14* (2013.01); *E21B 47/12* (2013.01)

(58) Field of Classification Search

CPC ..... E21B 43/16; E21B 47/12; E21B 17/1078; E21B 43/11; E21B 23/00

See application file for complete search history.

(56) References Cited

U.S. PATENT DOCUMENTS

| | | | | |
|---|---|---|---|---|
| 3,426,851 | A * | 2/1969 | Arendt | E21B 43/119 166/255.2 |
| 6,386,288 | B1 | 5/2002 | Snider et al. | |
| 6,557,636 | B2 | 5/2003 | Cernocky et al. | |
| 6,962,202 | B2 | 11/2005 | Bell et al. | |
| 9,366,134 | B2 | 6/2016 | Walton et al. | |
| 9,482,072 | B2 | 11/2016 | Fripp et al. | |
| 9,752,414 | B2 | 9/2017 | Fripp et al. | |
| 2002/0125011 | A1 * | 9/2002 | Snider et al. | E21B 43/117 166/297 |
| 2004/0206503 | A1 | 10/2004 | Bell et al. | |
| 2008/0164031 | A1 | 7/2008 | Howell et al. | |

(Continued)

*Primary Examiner* — Yong-Suk (Philip) Ro

(74) *Attorney, Agent, or Firm* — John Wustenberg; Parker Justiss, P.C.

(57) ABSTRACT

Provided is a downhole perforating device, a well system, and a method for perforating a well system. The downhole perforating device, in one aspect, includes a perforating structure for surrounding at least a portion of an outer surface of a wellbore casing. The downhole perforating device, according to this aspect, includes one or more perforation elements at least partially embodied within the perforating structure, the one or more perforation elements positioned to perforate the wellbore casing to an inside thereof, and electronics at least partially embodied within the perforating structure, the electronics for triggering the one or more perforation elements.

18 Claims, 5 Drawing Sheets

(56) References Cited

U.S. PATENT DOCUMENTS

| | | | | |
|---|---|---|---|---|
| 2012/0048539 | A1 | 3/2012 | Clark et al. | |
| 2012/0085538 | A1 | 4/2012 | Guerrero et al. | |
| 2017/0122096 | A1 | 5/2017 | Durtier et al. | |
| 2017/0241215 | A1 | 8/2017 | Kleppa | |
| 2017/0260838 | A1* | 9/2017 | Livescu et al. | E21B 44/00 |
| 2019/0071955 | A1* | 3/2019 | Al-Anazi | E21B 43/112 |

* cited by examiner

CASING CONVEYED, EXTERNALLY MOUNTED PERFORATION CONCEPT

CROSS-REFERENCE TO RELATED APPLICATION

This application claims the benefit of U.S. Provisional Application Ser. No. 62/692,125, filed on Jun. 29, 2018 entitled "CASING CONVEYED, EXTERNALLY MOUNTED PERFORATION CONCEPT," commonly assigned with this application and incorporated herein by reference.

BACKGROUND

A wide variety of downhole tools may be used within a wellbore in connection with producing hydrocarbons from a hydrocarbon formation. Downhole tools such as frac plugs, bridge plugs, and packers, for example, may be used to seal a component against production casing along the wellbore wall or to isolate one pressure zone of the formation from another. In addition, perforating guns may be used to create perforations through the production casing and into the formation to produce hydrocarbons.

Downhole tools are typically conveyed into the wellbore on a wireline, tubing string such as drill pipe or coiled tubing, or another type of conveyance. In some systems, the operator estimates the location of the downhole tool based on this mechanical connection and also communicates (e.g., electrically, optically, fluidically, etc.) with the tool through this mechanical connection. For example, the operator may send communications to the downhole tool via the conveyance to command the setting of a plug in the wellbore, or to command the firing of a perforating gun. This mechanical connection may be subject to various problems including it being a time consuming and costly operation, increased safety concerns, more personnel on site, and risk for breakage of the wireline connection, which would then require additional fishing operations to recover lost tools, some of which may include unfired perforating guns. The time and risk associated with these operations has resulted in the need for suitable alternative solutions that would mitigate these problems.

BRIEF DESCRIPTION

Reference is now made to the following descriptions taken in conjunction with the accompanying drawings, in which:

FIG. 1 schematically depicts a well system including an exemplary operating environment that the apparatuses, systems and methods disclosed herein may be employed;

DETAILED DESCRIPTION

Figure 1:
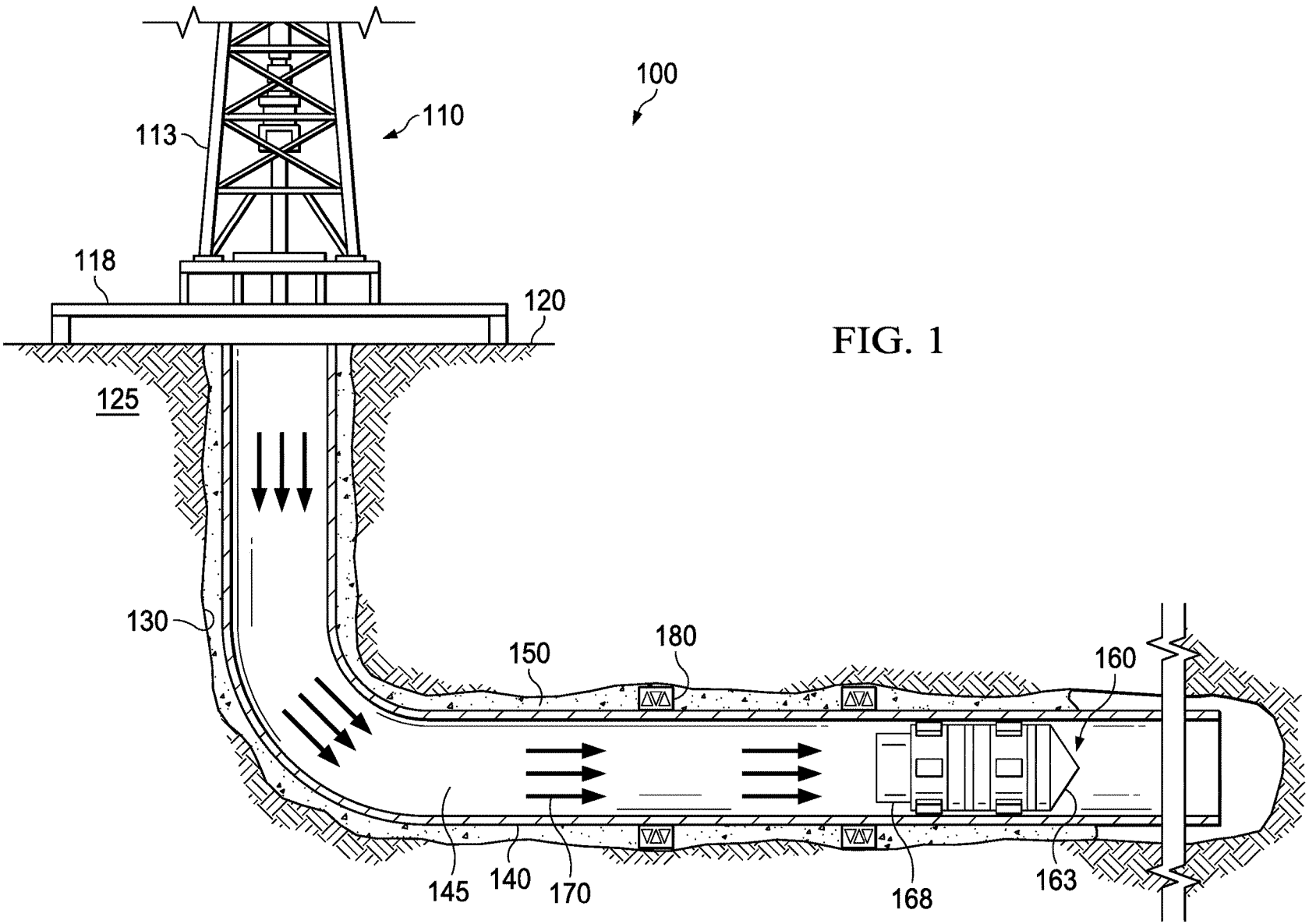

In the drawings and descriptions that follow, like parts are typically marked throughout the specification and drawings with the same reference numerals, respectively. The drawn figures are not necessarily, but may be, to scale. Certain features of the disclosure may be shown exaggerated in scale or in somewhat schematic form and some details of certain elements may not be shown in the interest of clarity and conciseness. The present disclosure may be implemented in embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results. Moreover, all statements herein reciting principles and aspects of the disclosure, as well as specific examples thereof, are intended to encompass equivalents thereof. Additionally, the term, "or," as used herein, refers to a non-exclusive or, unless otherwise indicated.

Unless otherwise specified, use of the terms "connect," "engage," "couple," "attach" describing an interaction between elements is not meant to limit the interaction to direct interaction between the elements and may also include indirect interaction between the elements described.

Unless otherwise specified, use of the terms "up," "upper," "upward," "uphole," "upstream" shall be construed as generally toward the surface of the well; likewise, use of the terms "down," "lower," "downward," "downhole" shall be construed as generally toward the bottom, terminal end of a well, regardless of the wellbore orientation. Use of any one or more of the foregoing terms shall not be construed as denoting positions along a perfectly vertical or horizontal axis. Unless otherwise specified, use of the term "subterranean formation" shall be construed as encompassing both areas below exposed earth and areas below earth covered by water, such as ocean or fresh water.

Referring to FIG. 1, depicted is a well system 100 including an exemplary operating environment that the apparatuses, systems and methods disclosed herein may be employed. For example, the well system 100 could use an untethered downhole tool assembly or downhole perforating device according to any of the embodiments, aspects, applications, variations, designs, etc. disclosed in the following paragraphs. The well system 100 often, but not exclusively, comprises a drilling or servicing rig 110 that is positioned on a terranean surface 120 (e.g., the earth's surface) and extends over and around a wellbore 130 that penetrates a subterranean formation 125. As those skilled in the art appreciate, the wellbore 130 may be created for the purpose of recovering hydrocarbons from the subterranean formation 125, disposing of carbon dioxide within the subterranean formation 125, injecting stimulation fluids within the subterranean formation 125, or combinations thereof, among other purposes. The wellbore 130 may be drilled into the subterranean formation 125 by any suitable drilling technique.

In an embodiment, the drilling or servicing rig 110 comprises a derrick 113 with a rig floor 118 through which a wellbore casing 140 (e.g., a completion string, liner, etc. generally defining an axial flowbore 145) may be positioned within the wellbore 130. The drilling or servicing rig 110 may be conventional and may comprise a motor driven winch and other associated equipment for lowering a tubular, such as the wellbore casing 140 into the wellbore 130, for example, so as to position the completion equipment at the desired depth.

While the operating environment depicted in FIG. 1 refers to a stationary drilling or servicing rig 110 and a land-based wellbore 130, one of ordinary skill in the art will readily appreciate that mobile workover rigs or wellbore completion units, well servicing units, coiled tubing units, and the like, may be similarly employed. One of ordinary skill in the art will also readily appreciate that the systems, methods, tools, and/or devices disclosed herein may be employed within other operational environments, such as areas below earth covered by water, such as ocean or fresh water In an embodiment, the wellbore 130 may extend substantially vertically away from the earth's surface 120 over a vertical wellbore portion, or may deviate at any angle from the earth's surface 120 over a deviated or horizontal wellbore portion. In alternative operating environments, portions or substantially all of the wellbore 130 may be vertical, deviated, horizontal, and/or curved. The aspects of the present disclosure are particularly useful in situations wherein the wellbore 130 includes a substantially horizontal section, although the present disclosure should not be limited to such.

In an embodiment, at least a portion of the wellbore casing 140 may be secured into position against the formation 125 in a conventional manner using cement 150. In additional or alternative embodiments, the wellbore 130 may be partially completed (e.g., partially cased and cemented) thereby resulting in a portion of the wellbore 130 being uncompleted (e.g., uncased and/or un-cemented), or the wellbore may alternatively be uncompleted.

Positioned within the wellbore 130 in the embodiment of FIG. 1 is an untethered downhole tool assembly 160 manufactured and designed according to the disclosure. In accordance with one embodiment, the untethered downhole tool assembly 160 includes a housing 163, as well as a signal generator 168 located on or in the housing 163. As will be understood in greater detail below, the signal generator 168 is capable of transmitting a passive or active signal to a downhole device (e.g., device 180 in one embodiment) located on an outside of the metal wellbore casing 140, for example while deploying the downhole tool assembly 160 within the wellbore proximate the downhole device, as the downhole tool assembly approaches the downhole device.

In accordance with the disclosure, the untethered downhole tool assembly 160 is moved along at least a partial length of the wellbore 130 via an external force. The external force, according to the disclosure, may be hydraulic pressure, or gravity, among other external forces. In the embodiment of FIG. 1, the untethered downhole tool assembly 160 is launched into the wellbore casing 140 via a lubricator (not shown) or simply dropped into the wellbore casing 140. Then, hydraulic pressure 170 provides the external force for moving the untethered downhole tool assembly 160 along at least a partial length of the wellbore casing 140.

In an embodiment, the untethered downhole tool assembly 160 is self-navigating. Namely, the untethered downhole tool assembly 160 is operable to self-determine its location within the wellbore casing 140 as the untethered downhole tool assembly 160 traverses downhole. Therefore, the untethered downhole tool assembly 160 does not require location communications from the surface 120, for example, to determine its location as in conventional systems. As a result, a wireline cable or other physical deployment means is not absolutely necessary. In an embodiment, the untethered downhole tool assembly 160 is operable to activate one or more of its functions at one or more sensed locations in response to command communications received from an external source, such as from another downhole device.

In another embodiment, the untethered downhole tool assembly 160 is self-activating. Namely, the untethered downhole tool assembly 160 is operable to self-activate one or more of its functions at sensed locations within the wellbore casing 140 without receiving command communications from an external source. Similarly, the untethered downhole tool assembly 160 may wirelessly command other downhole tools to perform one or more functions.

In accordance with one embodiment of the disclosure, the downhole tool is a downhole perforating device 180. The downhole perforating device 180, in this embodiment, includes a perforating structure for surrounding at least a portion of an outer surface of the wellbore casing 140. A perforation structure is a structure positionable around the outer surface of the wellbore casing, including but not limited to a sleeve, a partial sleeve, a plurality of hinged portions that collectively form a sleeve or partial sleeve, or any other configuration within the scope of the disclosure.

The downhole perforating device 180, according to the embodiment of FIG. 1, additionally includes one or more perforation elements at least partially embodied within the perforating structure. A perforation element is an element positionable on or in the perforating structure, including but not limited to an explosive charge element, explosive shaped charges, explosive tape charges, or a chemical perforation element. The perforation elements can be selectively activated in response to a signal from a downhole tool assembly, such as one or more of those disclosed herein, to create a perforation through the casing in proximity to the perforating element. Typically, the perforating elements are circumferentially spaced about the perforating structure and can be activated by the downhole tool assembly alone or in groups, to create (e.g., simultaneously create) the perforations at corresponding circumferential locations on the wellbore casing. The one or more perforation elements, in this embodiment, are positioned to perforate the wellbore casing to an inside thereof. The downhole perforating device 180, according to this embodiment, further includes electronics at least partially embodied within the perforating structure. The electronics, in this embodiment, are for triggering the one or more perforation elements. Additional details of the downhole perforating device 180 will be discussed in the following paragraphs. Additionally, more than one downhole perforating device, and as shown two downhole perforating devices, may simultaneously be used.

In accordance with one example method, the downhole perforating device 180 could discharge one or more of its perforation elements (e.g., charge elements, shaped charges, tape charges, chemical perforation elements, etc.) based upon a signal received from the untethered downhole tool assembly 160. In another embodiment, the downhole perforating device 180 could discharge one or more of its perforation elements based upon a signal received from a downhole tool different from the untethered downhole tool assembly 160.

Figure 2:
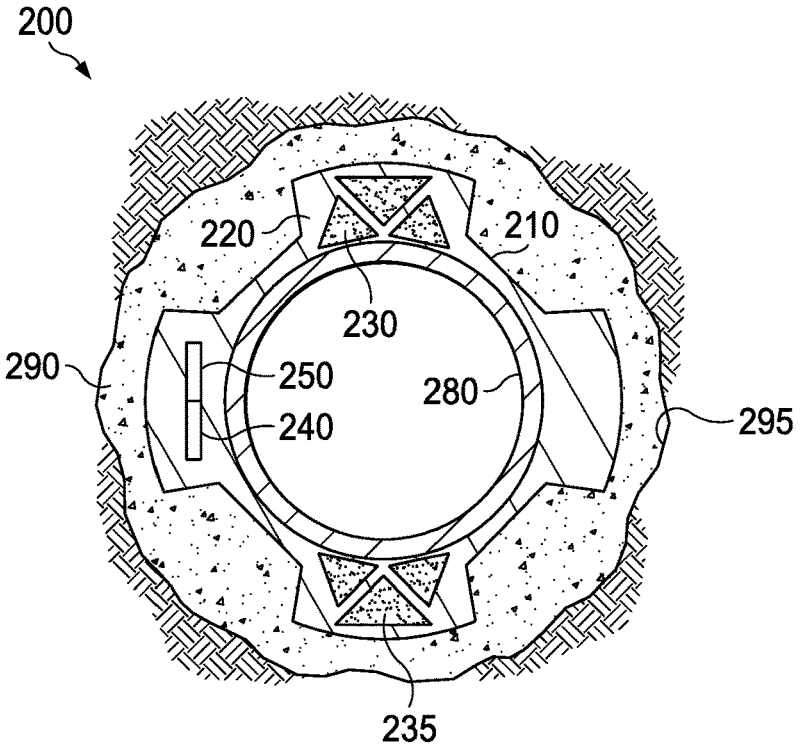
FIG. 2 illustrates a downhole perforating device manufactured and designed in accordance with the disclosure.

Turning to FIG. 2, illustrated is a downhole perforating device 200 manufactured and designed in accordance with the disclosure. The downhole perforating device 200 of FIG. 2, includes an externally mounted perforating structure 210 configured to surround an outer surface of a wellbore casing 280. The perforating structure 210 may comprise a sleeve, a partial sleeve, a plurality of hinged portions, or any other configuration within the scope of the disclosure. The wellbore casing 280, in accordance with the disclosure, may be any known or hereafter discovered wellbore casing, including a production casing generally comprising a metal or metal alloy. The perforating structure 210 is illustrated as surrounding an entirety of the wellbore casing 280 in the embodiment of FIG. 2. In other embodiments, however, the perforating structure 210 surrounds less than an entirety of the wellbore casing 280, but still at least a portion of the wellbore casing 280.

The perforating structure 210, in the embodiment of FIG. 2, includes two or more optional radially spaced wellbore casing centralizers 220 (e.g., two or more fins in the illustrated embodiment). In this embodiment, the wellbore casing centralizers 220 are configured to position the wellbore casing 280 in the center of a wellbore 295 to facilitate improved cement placement around the entire wellbore and ensure improved zone isolation. The casing centralizers 220 may vary in number and relative location. Nevertheless, in one embodiment, two substantially equally radially spaced casing centralizers 220 (e.g., radially spaced by 180±6 degrees) are used. In another embodiment, three substantially equally radially spaced casing centralizers 220 (e.g., radially spaced by 120±6 degrees) are used. In yet another embodiment, as shown, four substantially equally radially spaced casing centralizers 220 (e.g., radially spaced by 90±6 degrees) are used. While the embodiment illustrated in FIG. 2 employs the wellbore casing centralizers 220, other embodiments exist wherein the wellbore casing centralizers 220 are not used, and thus the wellbore casing 280 may or may not be centrally located within the wellbore 295.

Embedded within the externally mounted perforating structure 210, and in the embodiment of FIG. 2 within the wellbore casing centralizers 220, are one or more perforation elements 230. For simplicity, the perforation elements 230 will be discussed as charge elements from this point on. Nevertheless, those skilled in the art understand that the present disclosure is not limited to charge elements, and thus may employ chemical perforation elements or other types of perforation elements and remain within the scope of the disclosure. The charge elements 230, as those skilled in the art appreciate, are inwardly pointing charge elements and thus configured to perforate the production casing 280 to the inside thereof. In an optional embodiment, one or more outwardly pointing charge elements 235 may additionally be embedded within the externally mounted perforating structure 210. The optional outwardly pointing charge elements 235 may thus be configured to perforate any cement 290 or the wellbore 295 positioned radially outside of the perforating structure 210.

The charge elements 230, 235 can be in a single plane, in one embodiment. Furthermore, the charge elements may be designed for varying degrees of phasing. For instance, the charge elements 230, 235 may be designed for 0, 30, 45, 60, 90, 120, 135, 150, 180, 210, 225, 240, 270, 300, 315, 330 and 360 degrees, among other configurations. As indicated, the charge elements 230 may act as a primary charge designed to shoot from the outside to the inside of the wellbore casing 280, and in one embodiment are designed specifically to just penetrate the wellbore casing 280. The outwardly pointing charge elements 235 may act as a secondary charge designed to shoot further to the outside and penetrate the cement 290 and/or the wellbore 295 with minimal damage thereto. In yet another embodiment, a single charge element is configured to shoot from the outside to the inside of the wellbore casing 280 and shoot further to the outside and penetrate the cement 290 and/or the wellbore 295. While the externally mounted perforating structure 210 is configured in the embodiment of FIG. 2 to include the casing centralizers 220, which in this embodiment are in a scalloped design, other embodiments exist wherein the externally mounted perforating structure does not include the scalloped design, and thus the features of the downhole perforating device 200 are contained within a central portion of the perforating structure 210.

Further embedded within the externally mounted perforating structure 210, and in the embodiment of FIG. 2 within the casing centralizers 220, are electronics 240, and in certain embodiments one or more power sources 250. In the embodiment of FIG. 2, the electronics 240 and power source 250 are contained within a same casing centralizer 220. In other embodiments, however, the electronics 240 and power source 250 are contained within different casing centralizers 220 (e.g., a third of the three or more substantially equally spaced wellbore casing centralizers), or other areas of the perforating structure 210. As those skilled in the art appreciate, the electronics 240, among other uses, may be used to trigger the one or more charge elements 230, 235, for example using a triggering signal. Accordingly, the electronics 240 may include a receiver for sensing a radio frequency signal, electromagnetic signal, magnetic signal, acoustic signal, vibration signal, or radiation signal emanating from inside the wellbore casing. The electronics 240 may also include a receiver for receiving activation energy from a powered device positioned within the wellbore casing 280. The power source 250, as those skilled in the art appreciate, may be used for powering the electronics and other features of the downhole perforating device 200.

Figure 3:
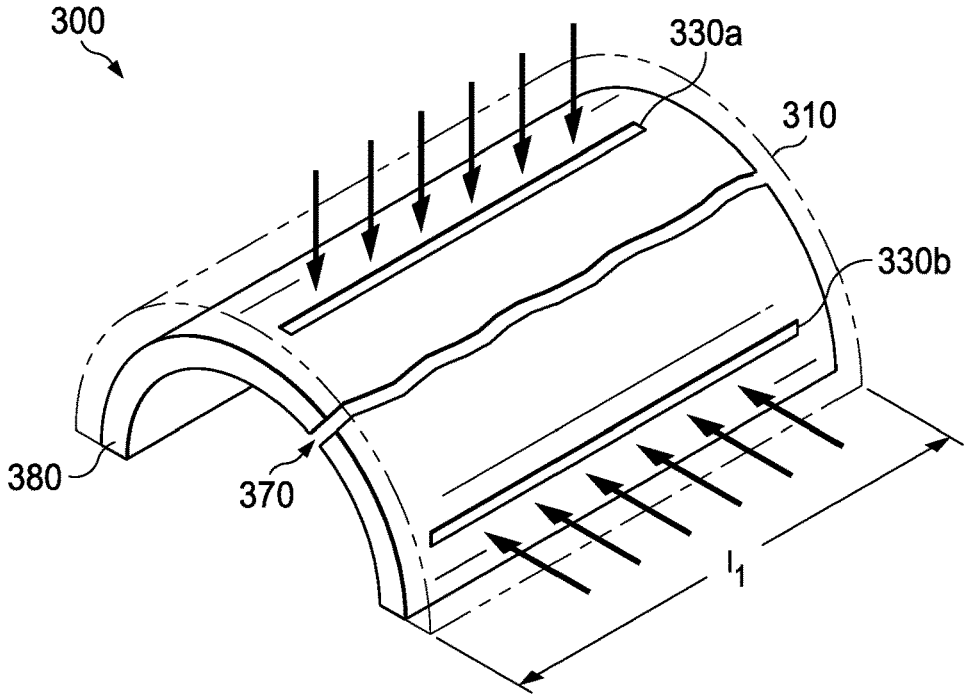
FIG. 3 illustrates an alternative embodiment of a downhole perforating device manufactured and designed in accordance with the disclosure.

Turning to FIG. 3, illustrated is an alternative embodiment of a downhole perforating device 300 including a perforating structure 310 having a length ($l_1$) manufactured and designed according to the disclosure. In the embodiment of FIG. 3, two inwardly pointing charge elements 330*a* and 330*b* are placed radially offset by one another in the perforating structure 310 and outside of the production casing 380. For example, and without limitation, the inwardly pointing charge elements 330*a* and 330*b* could be radially offset from one another by anywhere from 5 to 30 degrees, among other offsets. In the embodiment shown, the two inwardly pointing charge elements 330*a* and 330*b* are two radially offset sheet/tape explosive elements that are axially aligned with the length ($l_1$) of the perforating structure 310. Accordingly, when used in this fashion, the two radially offset sheet/tape explosive elements may form one or more axial perforations 370 in the production casing 380. While one specific range for the radial offset of the inwardly pointing charge elements 330*a* and 330*b* has been given, the present disclosure is not limited to such. Furthermore, while it has been illustrated that two radially offset sheet/tape explosive elements are used to form the axial perforations 370, those skilled in the art understand that other situations may exist where a plurality of individual charge elements are axially aligned to form one or more axial perforations 370. While the two inwardly pointing charge elements 330*a* and 330*b* are two radially offset sheet/tape explosive elements that are axially aligned with the length ($l_1$) of the perforating structure 310 in the embodiment of FIG. 3, other embodiments exist wherein the two inwardly pointing charge elements 330*a* and 330*b* are two radially offset sheet/tape explosive elements that are linearly placed along the length ($l_1$) of the perforating structure 310, for example spiraling up or down the perforation assembly 310.

By mounting the charge elements 330*a*, 330*b* on the outside of the wellbore casing 380, they can be spaced at any desired location along multiple casing joints, even running more than one downhole perforating device 300 per joint of wellbore casing if it is desired to do so. This process is completely different from conventional perforating where the charge elements are run inside the wellbore casing and shaped charges are used to perforate from the inside, through the wellbore casing and into the formation. In the disclosed situation, the charge elements 330*a*, 330*b* are mounted outside of the wellbore casing and designed to perforate from the outside in, leaving a relatively undamaged portion of cement and formation exposed to the wellbore that may be much better suited for hydraulic fracture initiation than a perforation tunnel that is filled with compacted perforation debris and the associated local stress modification immediately around the created perforation tunnel. Thus, in certain embodiments, the downhole perforating devices 300 is void of any charge elements positioned to perforate radially away from the wellbore casing 380. Furthermore, whether the downhole perforating device 300 includes charge elements positioned to perforate radially away from the wellbore casing 380 or not, any of said charge elements may be positioned so as to avoid perforation of any undesirable features on the outside diameter of the perforating device 300. For instance, the charge elements may be positioned to avoid damaging any fiber optic cables, electric cables, hydraulic lines, etc. that may be positioned radially outside of the perforating device 300. Such positioning may be achieved using one or more of the centralizers (e.g., centralizer 220 of FIG. 2).

Because of this unique feature, it is possible to consider charge elements that are low profile and can fit into a small space. One such concept includes a linear type charge using a deflector to simultaneously direct the energy inward through the wellbore casing and outward into the formation. Further, the low-profile aspect of the geometry lends itself well to the utilization of sheet/tape explosives as an alternative to conical and linear shaped charges. In one concept a sheet/tape explosive can be located inside the perforating structure and detonated simultaneously at opposing edges, thus driving detonation waves that create a cutting plane in the middle, such as the axial perforations 370 shown in FIG. 3.

It is envisioned that each downhole perforating device 300 may have a unique identification/sensing device built therein that can be utilized to selectively trigger the firing process. For example, it is envisioned that the electronics of the downhole perforating device 300 include a receiver for sensing a radio frequency signal, electromagnetic signal, magnetic signal, acoustic signal, vibration signal, radiation signal or other energy source emanating from inside the wellbore casing 380 and trigger the firing process. The one or more charge elements, such as the charge elements 330*a*, 330*b*, could be electrically, optically, magnetically, radio frequency (wireless), or mechanically coupled to the receiver. In the embodiments shown, the receiver is located radially outside an inner diameter of the wellbore casing 380. Other embodiments exist, however, where the receiver is located radially inside the inner diameter of the wellbore casing, for example if the signal is such that it cannot travel through the metal wellbore casing 380.

Rather than using wireline to trigger the downhole perforating device, it is envisioned that an untethered downhole tool assembly (e.g., smart plug in one embodiment) can be created that can be dropped into the wellbore casing from the surface and then pumped into the wellbore (e.g., horizontal section of the wellbore). These untethered downhole tool assemblies can be pre-programmed to only trigger specific perforating devices and then to activate or set themselves after they pass the final perforating device to provide isolation from perforations located below, for example that may result from previous fracturing stages. For instance, the untethered downhole tool assembly could create the aforementioned radio frequency signal, electromagnetic signal, magnetic signal, acoustic signal, vibration signal, radiation signal, among other types of signals, which would be unique for each downhole perforating device.

It is also envisioned that these downhole perforating devices could be installed on the rig floor while running wellbore casing, or the downhole perforating devices could be installed on the wellbore casing at any desired time before running the wellbore casing, including at a specialized shop where the downhole perforating devices could be pre-spaced out on the wellbore casing at the specific desired intervals. The capability to pre-assemble these downhole perforating devices on the wellbore casing in advance to running the wellbore casing into the wellbore can significantly reduce the time required on location to run the wellbore casing into the wellbore, helping to reduce well costs.

Figure 4:
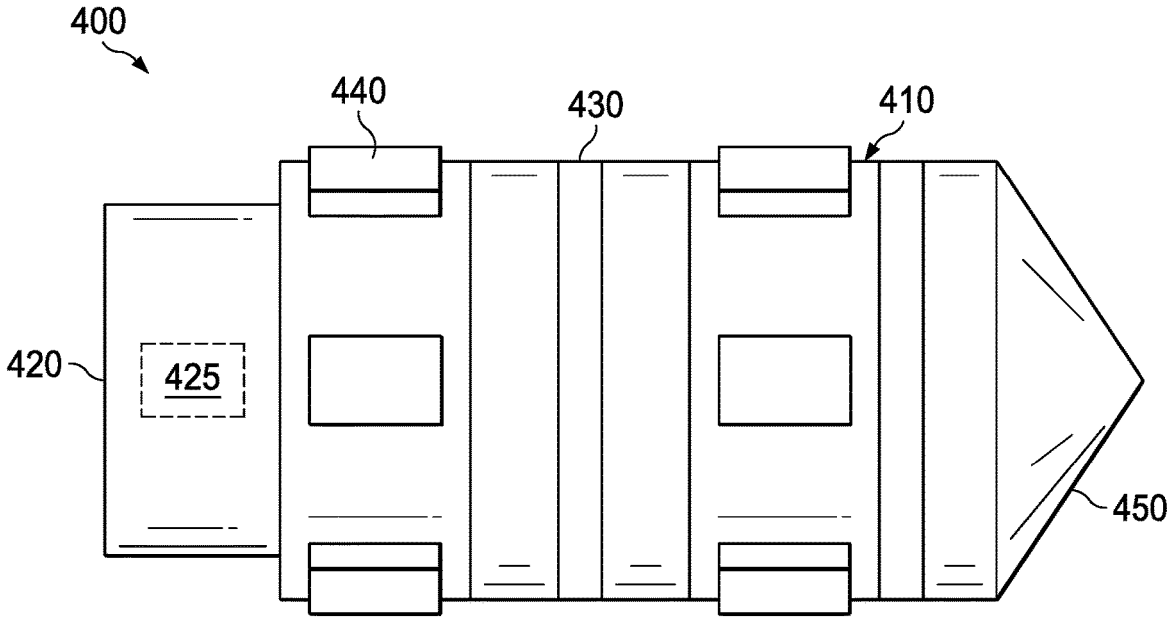
FIG. 4 illustrates a untethered downhole tool assembly manufactured and designed according to the disclosure.

Turning to FIG. 4, illustrated is an untethered downhole tool assembly 400 manufactured and designed according to the disclosure. The untethered downhole tool assembly 400, in the embodiment of FIG. 4, may be configured as a smart downhole plug assembly. The untethered downhole tool assembly 400, in the embodiment shown, includes a housing 410, as well as a signal generator 420 located on or in the housing 410. The signal generator 420, in this embodiment, is configured to transmit a passive or active signal to a downhole device located on an outside of a metal wellbore casing as it travels through an inside of the metal wellbore casing. For example, in one embodiment the signal generator 420 may be capable of transmitting a passive magnetic signal, passive acoustic signal, passive vibration signal, or a passive radiation signal through the metal wellbore casing. In one example, embodiment, perforation or other openings in the wellbore casing are not necessary for the signal generator 420 to send a signal through the wellbore casing. Said another way, the signal generator is operable through integral wellbore casing having no local holes or openings located therein. In an alternative embodiment, the signal generator 420 may further include a power source 425 located within the housing 410, and thus may be capable of transmitting an active wireless signal (e.g., through the metal wellbore casing (e.g., using a powered transmitter adapted to embed instructions on the active wireless signal).

The untethered downhole tool assembly 400 illustrated in FIG. 4 may additionally include a radially deployable packer element 430 coupled to the housing 410. The radially deployable packer element 430, in this embodiment, is thus movable from a radially retracted state to a radially deployed state, for example upon receiving one or more signals from the downhole device located on the outside of the wellbore casing, or alternatively using its self-navigating feature. The untethered downhole tool assembly 400 illustrated in FIG. 4 additionally includes one or more slip elements 440, as well as a nose section 450.

According to one embodiment, the untethered downhole tool assembly 400 may be pre-programmed (e.g. electrically) at the surface to activate targeted downhole perforating devices, among other pre-programmed features. An untethered downhole tool assembly 400, in accordance with one embodiment, is capable of communicating its position as it passes by each downhole perforating device. As it passes by the targeted downhole perforating device, the untethered downhole tool assembly 400 could trigger the activation of those downhole perforating devices for a delayed firing process. When the untethered downhole tool assembly 400 passes the final downhole perforating device, in one embodiment the untethered downhole tool assembly 400 would begin an automated setting process to set its packer element 430 just below the final downhole perforating device. An untethered downhole tool assembly, such as that discussed herein, may be constructed of a dissolvable or degradable material (e.g., metal comprising magnesium or aluminum or a plastic comprising an aliphatic polyester) for ease of removal following the completion of the oil/gas well.

There are several embodiments for how the untethered downhole tool assembly 400 can signal a downhole perforating device, such as the downhole perforating device 200, 300 shown in FIGS. 2 and 3. In one example, the untethered downhole tool assembly 400 can operate as a passive device. For example, the untethered downhole tool assembly 400 could have a signal generator built therein. A passive signal generator includes a magnet, an acoustic source, an RFID tag, radiation, or another similar passive indicator. In this embodiment, a receiver on the downhole perforating device reads the passing passive indictor. For example, a giant magnetoresistance (GMR) chip on the downhole perforating device might read the passing of the magnet on the untethered downhole tool assembly 400 and when the appropriate number of magnets had passed, the charge elements on the downhole perforating device would fire. An inductive coil in the downhole perforating device could also be used to detect the variation in the magnetic permeability from the untethered downhole tool assembly 400. In another example, a piezoelectric sensor in the downhole perforating device detects the scraping sound of the passing untethered downhole tool assembly 400 (e.g., an acoustic source or a vibration source).

In another example, an RFID reader on the downhole perforating tool detects the RFID tag on the untethered downhole tool assembly 400. Given that the wellbore casing often comprises metal or a metal alloy, in some cases the receiver of the downhole perforating device is on the ID of the wellbore casing (such as for the RFID). In other embodiments wherein the signal can pass through the wellbore casing, such as when the passive indicator is a magnetic passive indicator, the receiver of the downhole perforating device may be located on the outside diameter (OD) of the wellbore casing.

In another embodiment, the signal generator is an active signal generator. In such embodiments, the untethered downhole tool assembly 400 might use an electrically powered signal generator that transmits a wireless signal. The signal can be acoustic, magnetic, or electromagnetic, among others. In one embodiment, the downhole perforating device counts the number of wireless signals that are detected and fires after the target number of signals has passed. In another embodiment, the wireless signal consists of a digital encoded set of bits that has a header, an address, a command and/or error correction embedded therein, where the address is unique to an individual downhole perforating device or to a cluster of downhole perforating devices. In another embodiment, the wireless signal consists of an analog signal. The command may be to fire the charge elements, to fire the charge elements after a time delay, or to place the perforator into a "safe mode", among other commands. For example, the untethered downhole tool assembly 400 may have an electromagnetic signal emanating from a radio frequency identification (RFID) tag. In another application, the untethered downhole tool assembly 400 uses near-field communication to send the signal. In another example, a piezoelectric transmitter may create an acoustic signal that is detected by another piezoelectric receiver. In another example, a magnetic signal is transmitted from a coil within the untethered downhole tool assembly 400 to a coil within the downhole perforating device. These are but a few of the passive and active methods that might be used and remain within the purview of the disclosure.

The untethered downhole tool assembly 400 has been discussed above with regard to a downhole perforating device, but the untethered downhole tool assembly is not limited to such. For example, the untethered downhole tool assembly could be used to communicate with other downhole devices located on the outside of the wellbore casing, such as wellbore casing health sensors, wellbore cement health sensors, formation health sensors, etc. Accordingly, the untethered downhole tool assembly 400 may convey information to, and receive information from, such sensors as it is moving through the wellbore. Moreover, after the untethered downhole tool assembly 400 has completed its tasks, it or a portion of the device may return back uphole with the received information.

Figure 5:
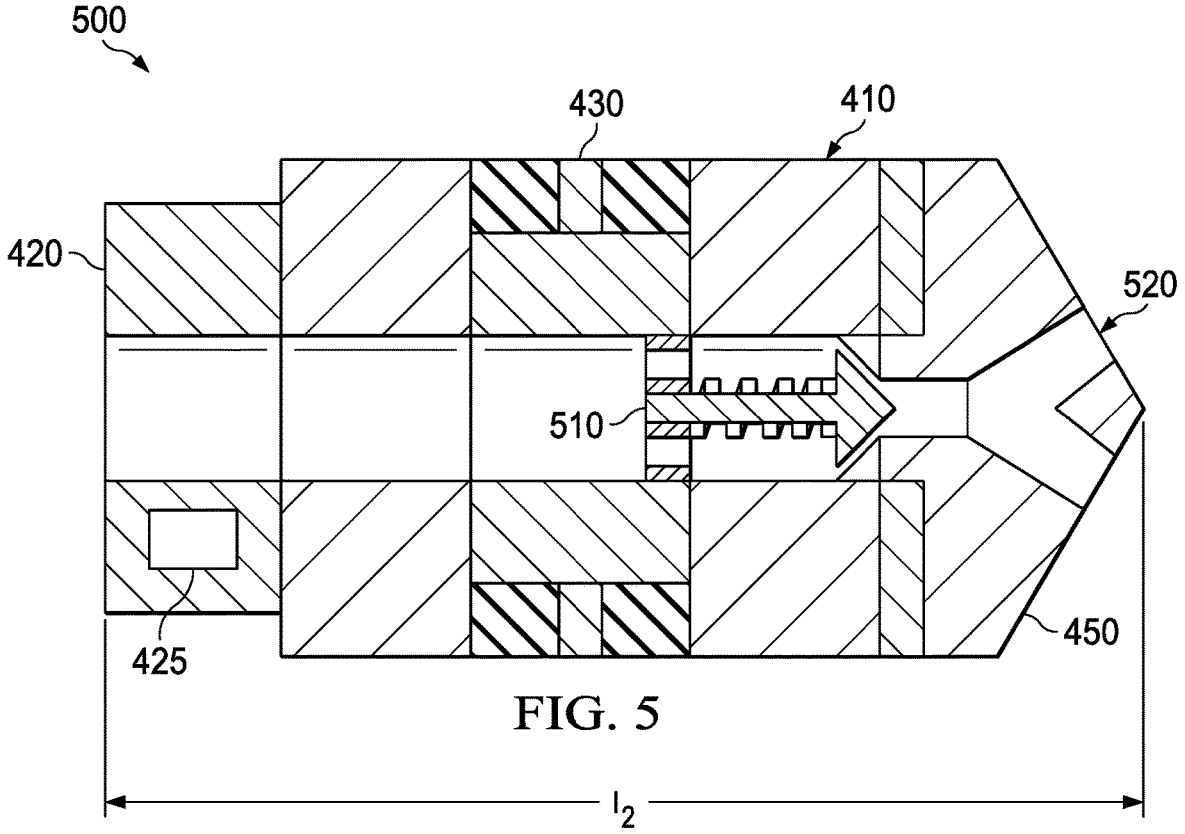
FIG. 5 illustrates an alternative embodiment of a untethered downhole tool assembly manufactured and designed according to the disclosure.

Turning briefly to FIG. 5, illustrated is an alternative embodiment of an untethered downhole tool assembly 500. The untethered downhole tool assembly 500 is similar in many respects to the untethered downhole tool assembly 400 illustrated in FIG. 4. Accordingly, like reference numbers may be used to indicate similar, if not identical, features. The untethered downhole tool assembly 500 includes a valve assembly 510 positioned across one or more fluid paths 520 within the interior thereof. In the illustrated embodiment of FIG. 5, the fluid paths extend along an entire length ($l_2$) of the housing 410. The valve assembly 510 and fluid paths 520, in this embodiment, allow the untethered downhole tool assembly 500 to free fall faster within a vertical section of the wellbore to reduce the time it takes to get to the desired location in the wellbore. The valve assembly 510 illustrated in FIG. 5 is a one-way valve assembly. In an alternative embodiment, the valve assembly 510 is a valve that can be triggered to close at a certain time based upon programming thereof, among other types of valves.

Figure 6:
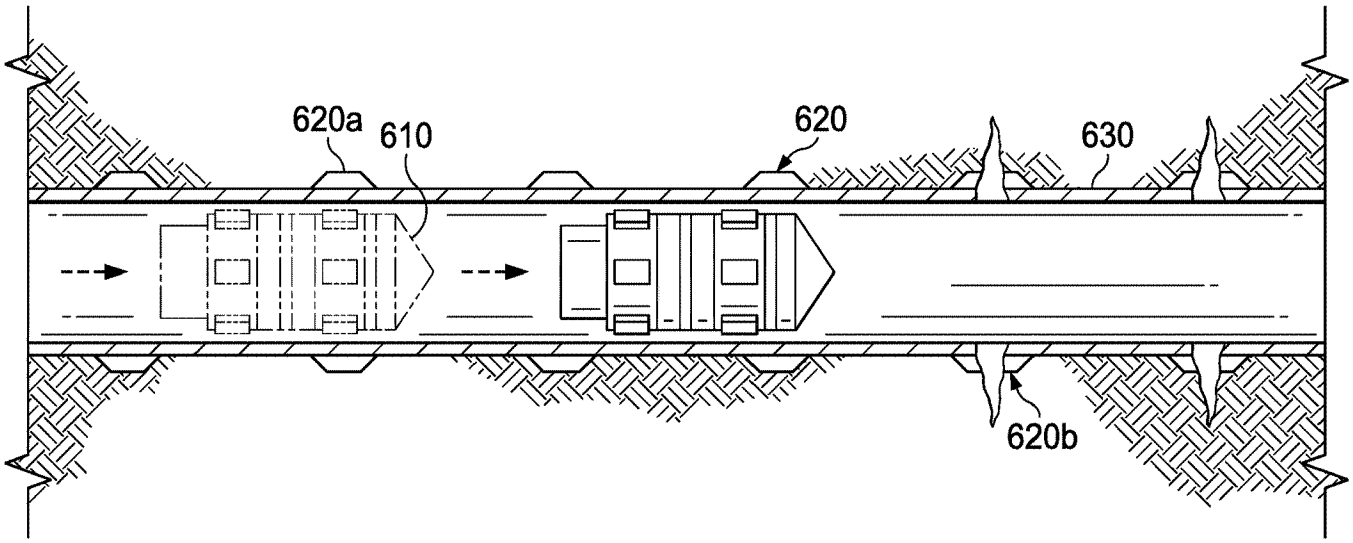
FIGS. 6 to 8 illustrate one example embodiment of how an untethered downhole tool assembly and downhole perforating device may be used in conjunction with one another.
Figure 7:
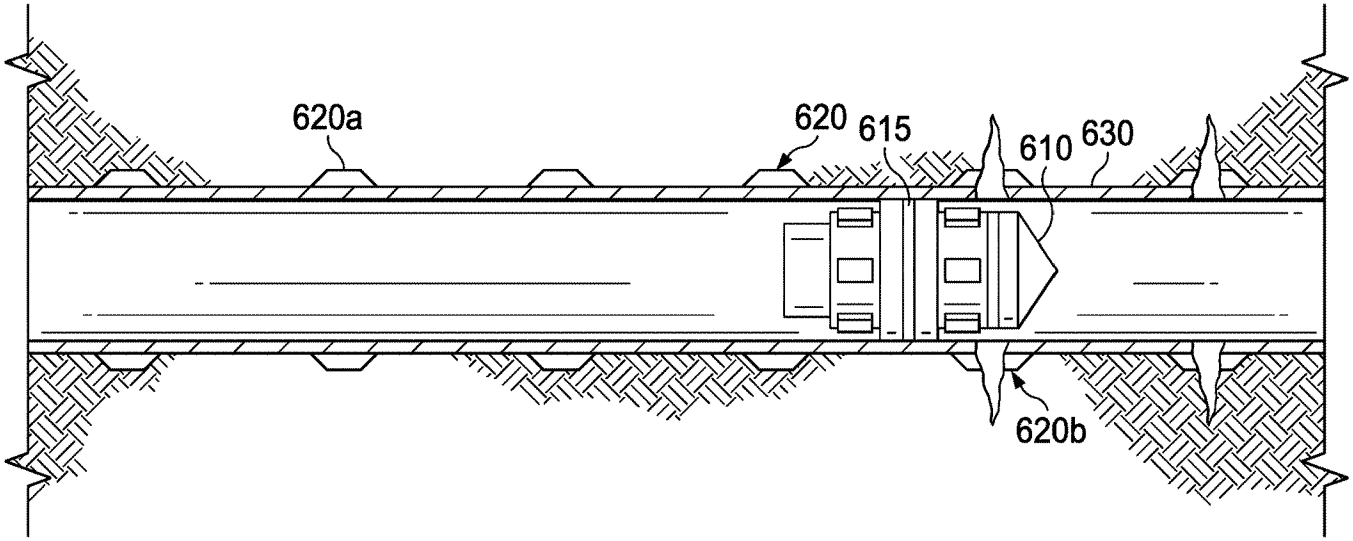
Figure 8:
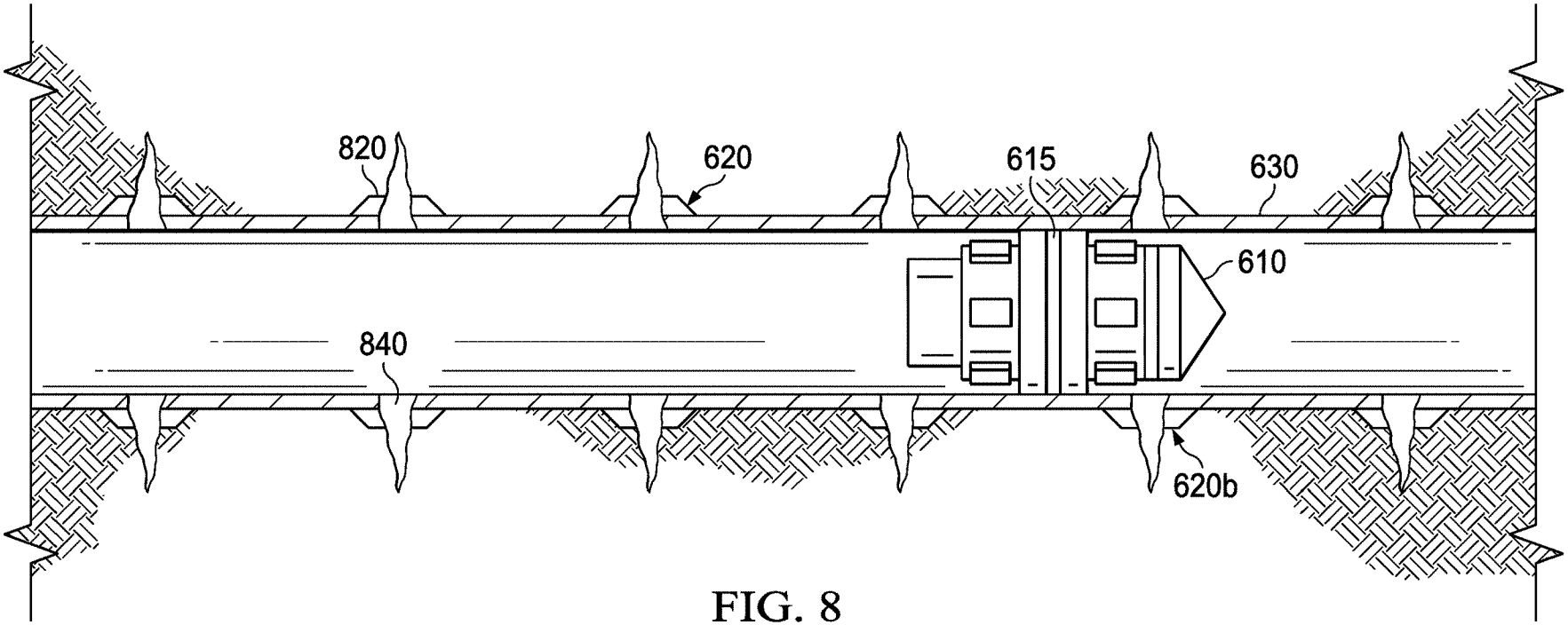

Turning now to FIGS. 6 to 8, illustrated is one example embodiment of how an untethered downhole tool assembly 610 and one or more downhole perforating devices 620 may be used in conjunction with one another. The method begins by positioning one or more downhole perforating devices 620 in a subterranean formation along an outer surface of a wellbore casing 630. In accordance with one embodiment of the disclosure, the downhole perforating devices 620 may each include a perforating structure surrounding at least a portion of the outer surface of the wellbore casing 630, one or more charge elements at least partially embodied within the perforating structure, the one or more charge elements positioned to perforate the wellbore casing to an inside thereof, and electronics at least partially embodied within the perforating structure, the electronics for triggering the one or more charge elements. In the illustrated embodiment of FIG. 6, four un-detonated downhole perforating devices 620*a* and two previously detonated downhole perforating devices 620*b* surround at least a portion of the wellbore casing 630.

As further shown in FIG. 6, with the downhole perforating devices 620 in place, the untethered downhole tool assembly 610 may be deployed downhole, for example by pumping the untethered downhole tool assembly 610 downhole. The untethered downhole tool assembly 610, in accordance with one embodiment, may include a housing, a signal generator located on or in the housing, the signal generator capable of transmitting a passive or active signal to a downhole device located on an outside of a metal wellbore casing as it travels through an inside of the metal wellbore casing, and a radially deployable packer element 615 coupled to the housing, the radially deployable packer element configured to move from a radially retracted state to a radially deployed state. As the untethered downhole tool assembly 610 passes the un-detonated downhole perforating devices 620*a*, the un-detonated downhole perforating devices 620*a* may be triggered for a delayed activation. For example, the untethered downhole tool assembly 610 might transmit a passive or active signal to the un-detonated downhole perforating devices 620*a* located outside of the metal wellbore casing 630 using its signal generator, and thus triggering the delayed activation.

As shown in FIG. 7, once the untethered downhole tool assembly 610 passes the last of the un-detonated downhole perforating devices 620*a*, and for example prior to the first of the previously detonated downhole perforating devices 620*b* or another location that is appropriate for sealing, the radially deployable packer element 615 associated with the untethered downhole tool assembly 610 may be set, for example sealing an upper region of the wellbore casing 630 from a lower portion of the wellbore casing 630. As shown in FIG. 8, the un-detonated downhole perforating devices 620*a* may then fire after the delayed trigger, forming additional detonated downhole perforating devices 820, and thus associated perforations 840 in the wellbore casing 630.

Aspects disclosed herein include:

A. A downhole perforating device, the downhole perforating device including a perforating structure for surrounding at least a portion of an outer surface of a wellbore casing, one or more perforation elements at least partially embodied within the perforating structure, the one or more perforation elements positioned to perforate the wellbore casing to an inside thereof, and electronics at least partially embodied within the perforating structure, the electronics for triggering the one or more perforation elements.

B. A well system, the well system including a wellbore extending from a terranean surface through a subterranean formation, a wellbore casing positioned within the wellbore, and a downhole perforating device positioned in the subterranean formation along an outer surface of the wellbore casing, the downhole perforating device including 1) a perforating structure surrounding at least a portion of the outer surface of the wellbore casing, 2) one or more perforation elements at least partially embodied within the perforating structure, the one or more perforation elements positioned to perforate the wellbore casing to an inside thereof, 3) electronics at least partially embodied within the perforating structure, the electronics for triggering the one or more perforation elements.

C. A method for perforating a well system, the method including positioning a downhole perforating device in a subterranean formation along an outer surface of a wellbore casing, the downhole perforating device including 1) a perforating structure surrounding at least a portion of the outer surface of the wellbore casing, 2) one or more perforation elements at least partially embodied within the perforating structure, the one or more perforation elements positioned to perforate the wellbore casing to an inside thereof, 3) electronics at least partially embodied within the perforating structure, the electronics for triggering the one or more perforation elements, and triggering the one or more perforation elements to form one or more perforations in the wellbore casing.

D. An untethered downhole tool assembly, the untethered downhole tool assembly including a housing, and a signal generator located on or in the housing, the signal generator capable of transmitting a passive or active signal to a downhole device located on an outside of a metal wellbore casing as it travels through an inside of the metal wellbore casing.

E. A method for operating a well system, the method including positioning a downhole device in a subterranean formation along an outer surface of a metal wellbore casing, deploying an untethered downhole tool assembly downhole within an inside of the metal wellbore casing, the untethered downhole tool assembly including 1) a housing, and 2) a signal generator located on or in the housing, and transmitting a passive or active signal to the downhole device located along the outer surface of the metal wellbore casing using the signal generator, as the untethered downhole tool assembly approaches the downhole device.

Aspects A, B, C, D and E may have one or more of the following additional elements in combination: Element 1: wherein the electronics include a receiver for sensing a radio frequency signal, electromagnetic signal, magnetic signal, acoustic signal, or vibration signal emanating from inside the wellbore casing. Element 2: wherein the receiver is located radially outside an inner diameter of the wellbore casing. Element 3: further including a power source at least partially embodied within the perforating structure, the power source for powering the electronics. Element 4: wherein the perforating structure has two or more radially spaced wellbore casing centralizers, and further wherein the one or more perforation elements are at least partially embodied within at least one of the two or more radially spaced wellbore casing centralizers. Element 5: wherein the perforating structure has three or more substantially equally radially spaced wellbore casing centralizers, and further wherein the one or more perforation elements are at least partially embodied within at least two of the three or more substantially equally radially spaced wellbore casing centralizers, and the electronics are at least partially embodied within a third of the three or more substantially equally radially spaced wellbore casing centralizers. Element 6: wherein the perforating structure has a length ($l_1$), and further wherein the one or more perforation elements are axially aligned along the length ($l_1$) of the perforating structure. Element 7: wherein the one or more perforation elements include one or more single sheet/tape charge elements axially aligned along the length ($l_1$) of the perforating structure. Element 8: wherein the downhole perforating device is void of perforation elements positioned to perforate radially away from the wellbore casing. Element 9: wherein the one or more perforation elements are one or more inwardly pointing charge elements, and wherein the downhole perforating device further includes one or more outwardly pointing charge elements positioned to perforate cement or a wellbore positioned radially outside of the perforating structure. Element 10: wherein the downhole perforating device is a first downhole perforating device, and further including a second downhole perforating device positioned between the first downhole perforating device and the terranean surface, the second downhole perforating device including a second perforating structure, one or more second perforation elements, and second electronics. Element 11: wherein the electronics include a receiver located radially outside an inner diameter of the wellbore casing for sensing a radio frequency signal, electromagnetic signal, magnetic signal, acoustic signal, or vibration signal emanating from inside the wellbore casing, and wherein the downhole perforating device further includes a power source at least partially embodied within the perforating structure, the power source for powering the electronics. Element 12: wherein the perforating structure has three or more substantially equally radially spaced wellbore casing centralizers, and further wherein the one or more perforation elements are at least partially embodied within at least two of the three or more substantially equally radially spaced wellbore casing centralizers, and the electronics are at least partially embodied within a third of the three or more substantially equally radially spaced wellbore casing centralizers. Element 13: further including cement positioned between the downhole perforating device and the wellbore, and wherein the one or more perforation elements are one or more inwardly pointing charge elements, and wherein the downhole perforating device further includes one or more outwardly pointing charge elements positioned to perforate the cement or the wellbore. Element 14: wherein the electronics include a receiver for sensing a radio frequency signal, electromagnetic signal, magnetic signal, acoustic signal, or vibration signal emanating from inside the wellbore casing, and further wherein triggering the one or more perforation elements includes deploying a downhole tool assembly having a transmitter within the wellbore proximate the downhole perforating device, and transmitting a triggering signal from the downhole tool assembly to the receiver thereby triggering the one or more perforation elements. Element 15: wherein the downhole tool assembly is an untethered downhole tool assembly. Element 16: further including cement positioned between the downhole perforating device and the wellbore, and wherein the one or more perforation elements are one or more inwardly pointing charge elements, and wherein the downhole perforating device further includes one or more outwardly pointing charge elements, and further including triggering the one or more outwardly pointing charge elements to form one or more second perforations in the cement or the wellbore. Element 17: wherein the downhole perforating device is a first downhole perforating device, and further including a second downhole perforating device positioned between the first downhole perforating device and a terranean surface, the second downhole perforating device including a second perforating structure, one or more second perforation elements, and second electronics, and further including triggering the one or more second perforation elements to form one or more second perforations in the wellbore casing. Element 18: wherein the signal generator is capable of transmitting a passive magnetic signal, passive acoustic signal, passive vibration signal, or a passive radiation signal through the metal wellbore casing. Element 19: further including a power source located within the housing, and further wherein the signal generator is a powered transmitter capable of transmitting an active wireless signal through the metal wellbore casing. Element 20: wherein the powered transmitter is adapted to embed instructions for the downhole device on the active wireless signal. Element 21: further including a radially deployable packer element coupled to the housing, the radially deployable packer element movable from a radially retracted state to a radially deployed state. Element 22: wherein the radially deployable packer element is movable from the radially retracted state to the radially deployed state upon receiving one or more signals from the downhole device located on the outside of the metal wellbore casing. Element 23: further including one or more slip elements coupled to the housing. Element 24: wherein the housing includes one or more fluid paths extending along an entire length ($l_2$) thereof. Element 25: further including a valve assembly positioned within the housing and across at least one of the one or more fluid paths for closing the one or more fluid paths. Element 26: wherein the housing comprises a dissolvable or degradable material. Element 27: wherein transmitting a passive or active signal includes transmitting a passive magnetic signal, passive acoustic signal, passive vibration signal, or a passive radiation signal through the metal wellbore casing. Element 28: further including a power source located within the housing, and further wherein transmitting a passive or active signal includes transmitting an active wireless signal through the metal wellbore casing. Element 29: wherein the active wireless signal has instructions for the downhole device embedded therein. Element 30: wherein the downhole device is a downhole perforating device, and further wherein the instructions are triggering instructions. Element 31: further including a radially deployable packer element coupled to the housing, and further including moving the radially deployable packer element from a radially retracted state to a radially deployed state upon receiving one or more signals from the downhole device located on the outside of the wellbore casing. Element 32: wherein the untethered downhole tool assembly further includes one or more slip elements coupled to the housing. Element 33: wherein the housing of the untethered downhole tool assembly includes one or more fluid paths extending along an entire length ($l_2$) thereof. Element 34: further including a valve assembly positioned within the housing and across at least one of the one or more fluid paths for closing the one or more fluid paths. Element 35: wherein the housing comprises a dissolvable or degradable material, and further including dissolving or degrading the housing after transmitting the passive or active signal to the downhole device located along the outer surface of the metal wellbore casing.

Those skilled in the art to which this application relates will appreciate that other and further additions, deletions, substitutions and modifications may be made to the described embodiments.

What is claimed is:

1. A downhole perforating device, comprising:

a perforating structure for surrounding at least a portion of an outer surface of a wellbore casing, the perforating structure having two or more radially spaced wellbore casing centralizers;

two or more radially spaced apart perforation elements at least partially embodied within the two or more radially spaced wellbore casing centralizers, the two or more perforation elements positioned to perforate the wellbore casing to an inside thereof; and electronics at least partially embodied within the perforating structure, the electronics for triggering the two or more perforation elements.

2. The downhole perforating device as recited in claim 1, wherein the electronics include a receiver for sensing a radio frequency signal, electromagnetic signal, magnetic signal, acoustic signal, or vibration signal emanating from inside the wellbore casing.

3. The downhole perforating device as recited in claim 2, wherein the receiver is located radially outside an inner diameter of the wellbore casing.

4. The downhole perforating device as recited in claim 1, further including a power source at least partially embodied within the perforating structure, the power source for powering the electronics.

5. The downhole perforating device as recited in claim 1, wherein the perforating structure has three or more substantially equally radially spaced wellbore casing centralizers, and further wherein the two or more perforation elements are at least partially embodied within at least two of the three or more substantially equally radially spaced wellbore casing centralizers, and the electronics are at least partially embodied within a third of the three or more substantially equally radially spaced wellbore casing centralizers.

6. The downhole perforating device as recited in claim 1, further including three or more perforation elements at least partially embedded within the perforating structure, and further wherein the perforating structure has a length ($l_1$), and further wherein at least two of the three or more perforation elements are axially aligned along the length ($l_1$) of the perforating structure.

7. The downhole perforating device as recited in claim 6, wherein the three or more perforation elements include one or more single sheet charge elements or tape charge elements axially aligned along the length ($l_1$) of the perforating structure.

8. The downhole perforating device as recited in claim 1, wherein the downhole perforating device is void of perforation elements positioned to perforate radially away from the wellbore casing.

9. The downhole perforating device as recited in claim 1, wherein the two or more perforation elements are two or more inwardly pointing charge elements, and wherein the downhole perforating device further includes one or more outwardly pointing charge elements positioned to perforate cement or a wellbore positioned radially outside of the perforating structure.

10. A well system, comprising:

a wellbore extending from a terranean surface through a subterranean formation;

a wellbore casing positioned within the wellbore; and a downhole perforating device positioned in the subterranean formation along an outer surface of the wellbore casing, the downhole perforating device including:

a perforating structure surrounding at least a portion of the outer surface of the wellbore casing, the perforating structuring including two or more radially spaced wellbore casing centralizers;

one or more perforation elements at least partially embodied within one of the two or more radially spaced wellbore casing centralizers of the perforating structure, the one or more perforation elements positioned to perforate the wellbore casing to an inside thereof; and electronics at least partially embodied within the perforating structure, the electronics for triggering the one or more perforation elements.

11. The well system as recited in claim 10, wherein the downhole perforating device is a first downhole perforating device, and further including a second downhole perforating device positioned between the first downhole perforating device and the terranean surface, the second downhole perforating device including a second perforating structure, one or more second perforation elements, and second electronics.

12. The well system as recited in claim 10, wherein the electronics include a receiver located radially outside an inner diameter of the wellbore casing for sensing a radio frequency signal, electromagnetic signal, magnetic signal, acoustic signal, or vibration signal emanating from inside the wellbore casing, and wherein the downhole perforating device further includes a power source at least partially embodied within the perforating structure, the power source for powering the electronics.

13. The well system as recited in claim 10, wherein the perforating structure has three or more substantially equally radially spaced wellbore casing centralizers, and further wherein the one or more perforation elements are at least partially embodied within at least two of the three or more substantially equally radially spaced wellbore casing centralizers, and the electronics are at least partially embodied within a third of the three or more substantially equally radially spaced wellbore casing centralizers.

14. The well system as recited in claim 10, further including cement positioned between the downhole perforating device and the wellbore, and wherein the one or more perforation elements are one or more inwardly pointing charge elements, and wherein the downhole perforating device further includes one or more outwardly pointing charge elements positioned to perforate the cement or the wellbore.

15. A method for perforating a well system, comprising:

positioning a downhole perforating device in a subterranean formation along an outer surface of a wellbore casing, the downhole perforating device including:

a perforating structure surrounding at least a portion of the outer surface of the wellbore casing;

one or more perforation elements at least partially embodied within the perforating structure, the one or more perforation elements positioned to perforate the wellbore casing to an inside thereof; and electronics at least partially embodied within the perforating structure, the electronics for triggering the one or more perforation elements, wherein the electronics include a receiver for sensing a radio frequency signal, electromagnetic signal, magnetic signal, acoustic signal, or vibration signal emanating from inside the wellbore casing; and triggering the one or more perforation elements to form one or more perforations in the wellbore casing, wherein triggering the one or more perforation elements includes deploying a downhole tool assembly having a transmitter within the wellbore proximate the downhole perforating device, and transmitting a triggering signal from the downhole tool assembly to the receiver thereby triggering the two or more perforation elements.

16. The method as recited in claim 15, wherein the downhole tool assembly is an untethered downhole tool assembly.

17. The method as recited in claim 15, further including cement positioned between the downhole perforating device and the wellbore, and wherein the one or more perforation elements are one or more inwardly pointing charge elements, and wherein the downhole perforating device further includes one or more outwardly pointing charge elements, and further including triggering the one or more outwardly pointing charge elements to form one or more second perforations in the cement or the wellbore.

18. The method as recited in claim 15, wherein the downhole perforating device is a first downhole perforating device, and further including a second downhole perforating device positioned between the first downhole perforating device and a terranean surface, the second downhole perforating device including a second perforating structure, one or more second perforation elements, and second electronics, and further including triggering the one or more second perforation elements to form one or more second perforations in the wellbore casing.

* * * * *